US006682264B1

(12) United States Patent
McGillis

(10) Patent No.: US 6,682,264 B1
(45) Date of Patent: Jan. 27, 2004

(54) METHOD OF ACCURATE TRENCHLESS INSTALLATION OF UNDERGROUND PIPE

(75) Inventor: John Hamilton McGillis, Houston, TX (US)

(73) Assignee: INA Acquisition Corp., Wilmington, DE (US)

( * ) Notice: Subject to any disclaimer, the term of this patent is extended or adjusted under 35 U.S.C. 154(b) by 0 days.

(21) Appl. No.: 10/084,542

(22) Filed: Feb. 26, 2002

(51) Int. Cl.[7] ..... E21D 1/06; F16L 1/00
(52) U.S. Cl. ..... 405/184; 175/53; 175/62
(58) Field of Search ..... 405/184, 184.2, 405/184.4, 184.5; 175/53, 61, 62

(56) References Cited

U.S. PATENT DOCUMENTS 3,894,402 A * 7/1975 Cherrington ..... 405/184
4,043,136 A * 8/1977 Cherrington ..... 405/161
4,117,895 A * 10/1978 Ward et al. ..... 175/53
4,679,637 A * 7/1987 Cherrington et al. ..... 175/61
RE33,793 E * 1/1992 Cherrington et al. ..... 175/61
5,427,475 A * 6/1995 Coss ..... 405/184
6,082,471 A * 7/2000 Osadchuk ..... 175/53
6,109,828 A * 8/2000 Keller ..... 405/146
6,206,109 B1 * 3/2001 Monier et al. ..... 175/53
6,250,403 B1 * 6/2001 Beckwith ..... 175/53

* cited by examiner

*Primary Examiner*—Robert E. Pezzuto
*Assistant Examiner*—Tara L. Mayo
(74) *Attorney, Agent, or Firm*—Reed Smith LLP; Michael I. Wolfson

(57) ABSTRACT

A method for the trenchless installation of new underground pipe accurately on line and on grade by microtunneling to install a pilot tube, installing a drill string along the pilot pipe line using a directional drilling machine, installing a back reamer to the drill string and using a directional drilling machine to pull back the reamer and install a product pipe behind the reamer. A pilot tube is installed on line and on grade by utilizing the guidance system of a microtunneling apparatus to install a pilot tubes between jacking and target shafts. A drill string is installed to displace the pilot tubes and a back reamer is attached to the drill string with a product pipe attached to the reamer. The reamer may be pulled using any suitable pulling device such as a directional drilling machine.

12 Claims, 10 Drawing Sheets

METHOD OF ACCURATE TRENCHLESS INSTALLATION OF UNDERGROUND PIPE

BACKGROUND OF THE INVENTION

This invention relates to the trenchless installation of underground pipe, and more particularly to precise on target installation underground of a pilot pipe by microtunneling and back reaming to pull in a product pipe along the pilot pipe line.

Microtunneling and horizontal directional drilling are two conventionally used processes for the trenchless installation of new underground pipe. Of the two processes, microtunneling is used for installation of sewer pipes in view of the ability to align the pipe along a line and grade accurately. Horizontal directional drilling or "HDD" has been traditionally used for installation of utilities not requiring precise line and grade alignments such as water pipes or high-tech fiber optic cable.

In microtunneling, an entry or jacking shaft is dug, reinforced with a corrugated steel liner. A jacking or displacement machine is accurately positioned and secured in the jacking shaft with a view towards displacing a pilot pipe along a predetermined line and grade to a target shaft also lined with a corrugated steel liner. In the first phase of a typical three phase microtunneling installation, a first section of a hollow pilot tube with a steering tip at the forward end is jacked into the ground towards the target shaft displacing the soil in front of it. An LED target is placed in the first section of pilot tube and accurate measurements of alignment are made using a theodolite securely positioned in the entity shaft. The lighted target allows for accurate for precise placement on line and grade of the pilot pipe. Steering is accomplished by rotation of the pilot pipe to rotate the steering tip. Successive sections of pilot tubes are secured to the proximal end of the pilot pipe until the target shaft is reached forming the pilot pipe. A typical pilot tube is about 4 inches in diameter.

In the second phase of the process, a reamer head with a temporary steel casing is fitted on the proximal end of the last section of pilot pipe. A central auger is positioned in the steel casing to remove soil behind the reamer. The reamer assembly is then jacked in behind the pilot pipe in sections to replace the pilot tubes and enlarge the pilot bore to desired size. A reamer as large as 20 inches in diameter may be used. The displaced pilot tubes are removed section-by-section in the target shaft. In the third phase, a product pipe is installed by jacking in behind the temporary steel casing section-by-section as described in connection with the pilot tubes. The steel casings and augers are then removed from the target shaft.

Microtunneling may also be done in two phases. Here, the first phase is identical to the three phase process with the pilot tubes jacked into the ground displacing the soil before it. In the second phase a large diameter reamer is fitted to the last pilot tube and advanced along the pilot pipe line. A pipe assembly of a product pipe with a central temporary steel casing and a central auger positioned therein is jacked in behind the reamer. Pilot tube sections are removed at the target shaft. Soil is removed by the auger and water or a drilling fluid may be injected at the face of the reamer to form a slurry that is displaced along the annulus between the product pipe and slightly larger reamer bore hold.

In horizontal directional drilling, digging entry shafts to grade below ground level are not generally required since the process is utilized for laying underground cable and the like from above the surface. The HDD process is generally used to install horizontal pipes beneath major obstacles, such as road or rivers. In this case accuracy of positioning along line and grade is not as critical as in the case of installing a new gravity-fed sewer line where deviations in line or grade are not acceptable. A directional drilling machine is positioned above ground and advances a rotating drill stem with a directional drill bit at the distal end in a direction inclined to the earth's surface to establish an initial bore hole. The rotation and advancement of the drill string are then leveled off at the required depth and then upwardly inclined back to a terminal point at the surface. The necessary deviation in line of the drill string is accomplished by a bit having a slanted face, an asymmetric drill head, eccentric fluid jets or a combination of these designs. They are typically used with an electronic locator instrument to determine position and strength of signal emitted from a transmitter in the head of the drill string of the boring system.

The drill string is in the form of a plurality of lengths of drill, generally about 15 feet in length. Each drill pipe section is provided with a male thread at one end and a female thread on the other so that the pipe may be interconnected together in sequence to provide a drill string of suitable length. The pilot bore formed by the drill string is then enlarged by a wash over pipe and a back reamer to the size required for pulling in the product pipe.

Both microtunneling and HDD methods are entirely suitable for their intended uses. The microtunneling process is extremely accurate, but relatively slow compared to the speed of installation utilizing directional drilling. The need to prepare shafts to grade level in microtunneling is avoided in the horizontal directional drilling process. However, the accuracy required for installation of new sewer pipes cannot be attained utilizing traditional horizontal directional drilling equipment and processing. This is due in large part to the inherent inability to control direction of the drill bit along accurate line and grade.

Accordingly, it is desirable to provide an improved method for accurately installing a new underground pipeline attaining the accuracy possible with microtunneling and at the speed available with directional drilling.

SUMMARY OF THE INVENTION

Generally speaking, in accordance with the invention, a method for the trenchless installation of underground pipes utilizing the accuracy and steering capability of a microtunneling guidance system to install a pilot pipe, installing a drill string in the pilot pipe bore and then pulling back a reamer with a product pipe attached as in directional drilling is provided. A jacking shaft and target shaft are dug and lined with corrugated steel shaft liners. A jacking machine is installed in the jacking shaft, aligned and pilot tubes are displaced towards to the target shaft. Precise alignment is maintained by use of an LED target in the first tube and a theodolite in the jacking shaft, or a laser system and any precise alignment system.

The pilot pipe is replaced by segments of drill pipes using a directional drilling machine to form a drill string through the jacking shaft and pilot pipe bore. The pilot tubes are removed from the target shaft. A back reamer is then installed in the target shaft and coupled to the drill string with a product pipe behind the reamer. The reamer is then rotated and pulled back along the line of the pilot bore by removing the drill pipe sections at the directional drilling machine. Water or a drilling fluid is introduced at the cutting face of the reamer through the hollow core of the drill string. The product pipe attached to the back end of the reamer is accurately positioned as the reamer travels along the path formed by the pilot tubes. Pullback may be accomplished by utilizing the horizontal directional drilling machine.

Accordingly, it is an object of the invention to provide an improved trenchless method of accurately installing an underground pipe.

Another object of the invention is to provide an improved method of installing an underground pipe by utilizing the steering capability of microtunneling guidance systems to install pilot tubes to form a pilot pipe.

A further object of the invention is to provide an improved method for trenchless installation accurately of underground pipe utilizing the speed of pulling in a product pipe along the line of a pilot pipe bore.

Yet another object of the invention is to provide an improved method for trenchless installation of underground pipes by installing a drill string by horizontal directional drilling to replace a pilot pipe installed by microtunneling.

Yet a further object of the invention is to provide an improved method of installing an underground pipe by pulling in a back reamer with a product pipe attached using a direction drilling rig.

Still other objects and advantages of the invention will in part be obvious and will in part be apparent from the specification.

The invention accordingly comprises the several steps and the relation of one or more of the steps with respect to each of the others, the apparatus and embodying features of construction, combination and arrangement of parts which are adapted to effect such steps, all as exemplified in the following disclosure, and the scope of the invention will be indicated in the claims.

BRIEF DESCRIPTION OF THE DRAWINGS

For a fuller understanding of the invention, references had to the following description taken in connection with the accompanying drawings in which.

DESCRIPTION OF THE PREFERRED EMBODIMENTS

Figure 1:
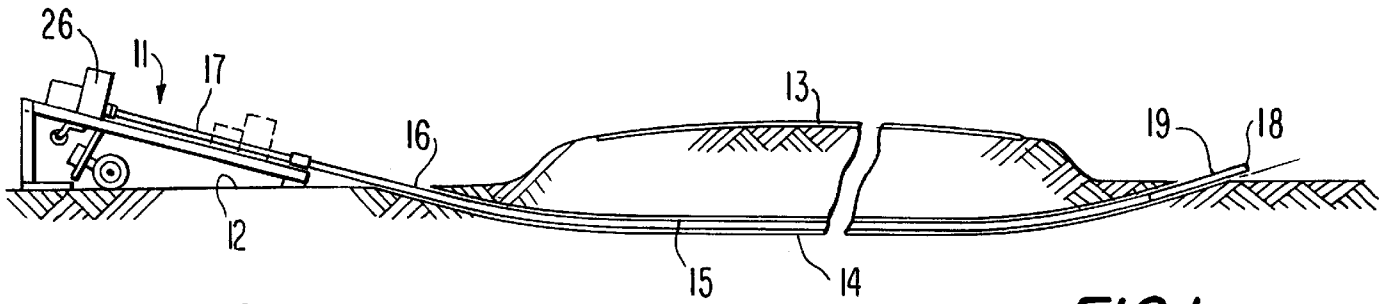
FIG. 1 is a side elevational view of a horizontal directional drilling machine and bore under an existing obstacle.

FIG. 1 illustrates a conventional boring machine 11 utilized in horizontal directional drilling. Boring machine 11 is shown resting on surface 12 adjacent to a roadway 13. Boring machine 11 is utilized to form a bore hole 14 underneath roadway 13 by advancing a hollow drill string 15 through surface 12 at entry point 16 to form bore hole 14. Drill string 15 is formed of a plurality of connected drill pipes 17 generally about 15 feet in length by boring machine 11. Drill string 15 includes a drill bit 18 as shown in FIG. 2 at the leading end for forming bore hole 14 and it reaches surface at an exit opening 19.

Figure 2:
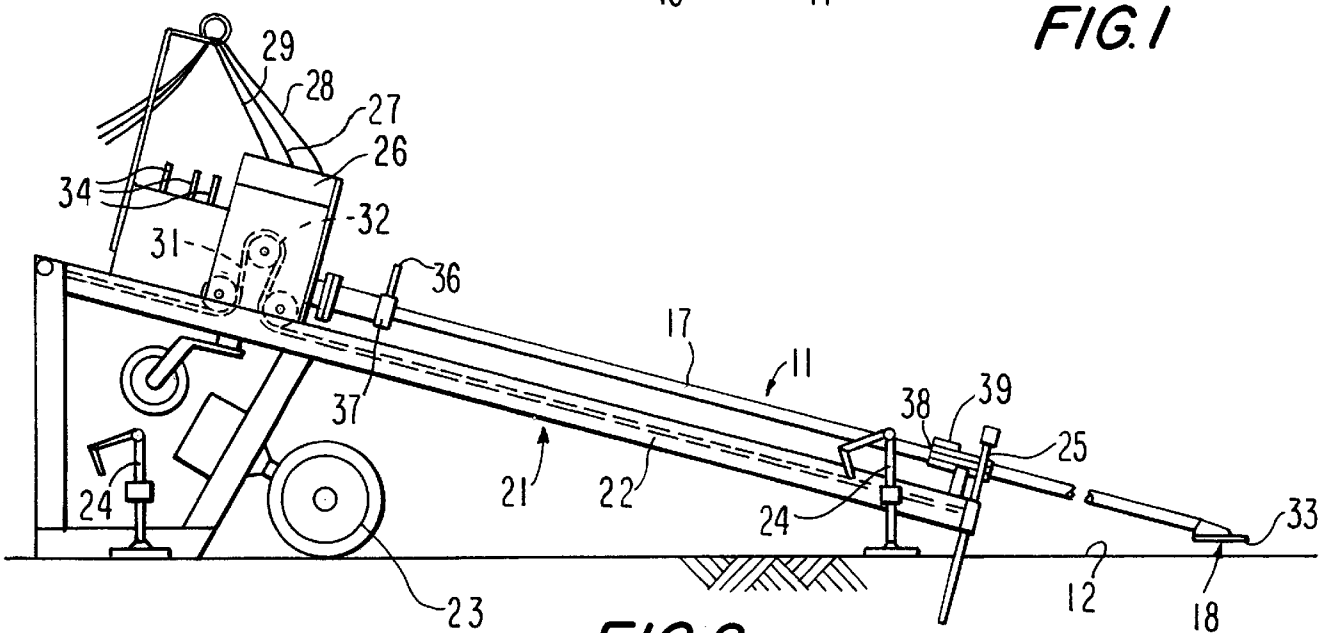
FIG. 2 is an enlarged schematic view of the drilling machine of FIG. 1.

Referring now to FIG. 2, boring machine 11 includes a frame 21 having an inclined platform 22 mounted on wheels 23 which can be placed in a selected position on surface 12. Once the position is located, jacks 24 and a pin 25 are secured to fix the position of boring machine 11. A rotating machine 26 is displacebly mounted on inclined platform 22. In the embodiment illustrated, rotating machine 26 is a hydraulically driven machine, but may be an electrical motor or a gas-driven engine. The complete details with respect to this type of boring machine 11 is shown and described in U.S. Pat. No. 4,953,638, the contents of which are incorporated herein by reference. When rotating machine 26 is driven by a hydraulic pump (not shown), it includes a pair of hoses 27 and 28 for coupling to the hydraulic pump. In addition, a water hose 29 is connected to drill pipes 17 being installed if fluid is to be provided to drill bit 18 during the course of boring.

During the drilling operation, rotating machine 26 is displaced along inclined platform 22 by displacement along a chain 31 wound about a series of cogwheels 32 mounted on rotating machine 26. The profile of a typical steering drill bit utilized in forming bore hole 14 is shown in profile in FIG. 2. Drill bit has a planar blade 33 for adjusting the boring direction. Sections of drill pipe 17 are positioned on inclined platform 22 between a shaft 37 and a guide 38 that has a sight 39.

Boring machine 11 is utilized to form bore hole 14 by rotating drill string 15 and by utilizing control levers 34 causing rotating machine 26 to linearly advance along the travel path of inclined platform 22. Drill bit 18, rotating and advancing, enters the earth at entry point 16 and forms bore hole 14. As long as bit 18 is rotated as it is advanced, bore hole 14 follows generally the axis of drill pipe 17. After extending downwardly to a level beneath roadway 13, the operator then changes the direction of drilling so as to drill horizontally beneath roadway 13. This is generally accomplished by orienting drill string 16 so that drill bit blade 33 is oriented in the desired horizontal direction. Orientation of blade 34 can be determined by position of a pointer 36 mounted on rotating machine 26. With blade 34 positioned horizontally as shown in FIG. 2, rotating machine 26 is stopped and advanced forward to cause bit 18 to become horizontally oriented. At this point, rotation of drill pipe 17 is resumed so that the boring continues along a horizontal path beneath roadway 13. When the appropriate distance is reached, an upward steering operation is performed in the same manner. In this case, drill bit 18 reorients bore hole 14 towards surface 13 so that bit 18 emerges from surface 12 at an exit opening 19. The directional drilling process utilizing a boring machine 11 of the type illustrated in FIG. 2 is relatively quick and depending on the soil conditions can proceed at rates of about 600 feet per day. The limiting factor generally is the speed with which additional segments of drill pipe 17 can be coupled to drill string 15 so that the drilling operation can continue.

Figure 3:
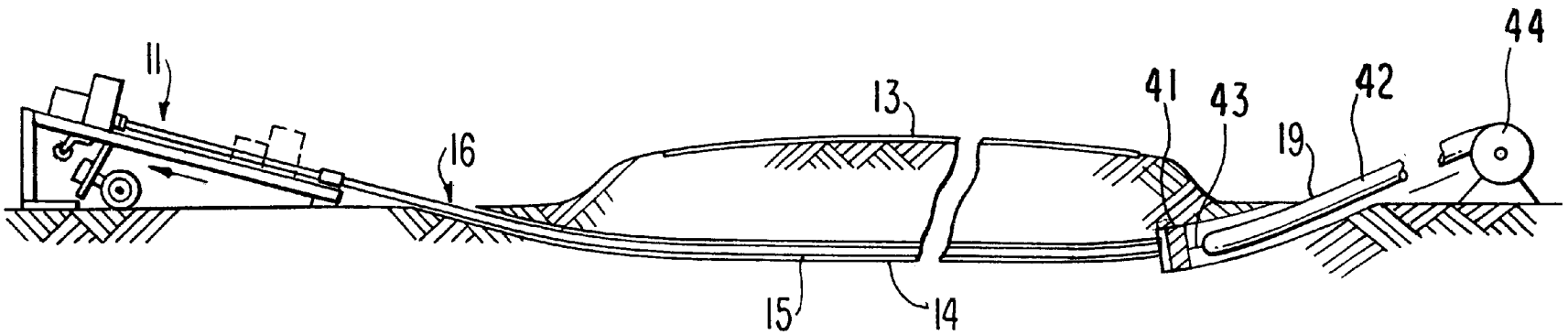
FIG. 3 is a side elevational view of a back reamer pulling in a product pipe into the bore hole in FIG. 1.

Turning to FIG. 3, once drill string 15 emerges from opening 19, a back reamer 41 with a product pipe 42 attached thereto is coupled to the distal end of drill string 15 by a swivel joint 43. When product pipe 42 is polyethylene, a continuous length stored on a reel 44 can be utilized. Drill string 15 is rotated in the counter-clockwise direction and pulled back towards entry 15 by boring machine 11 causing bore hole 14 to be enlarged to the desired dimension. As bore hole 14 is enlarged by back reamer 41, product pipe 42 is pulled into place to complete the installation of product pipe 42. When rigid pipe is to be installed, sections may be attached to back reamer 41 and pulled in a similar manner with additional sections of product pipe added. A typical installation of 200 feet per day is possible. Water or drilling fluid can be introduced at reamer 41 through the hollow core of drill string 15.

Figure 4A:
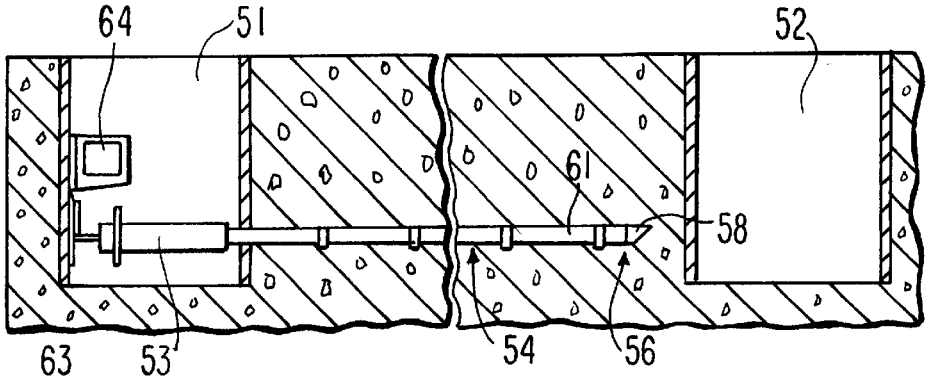
FIGS. 4(*a*), 4(*b*) and 4(*c*) are schematic drawings showing the steps in a three phase standard microtunneling process.
Figure 4B:
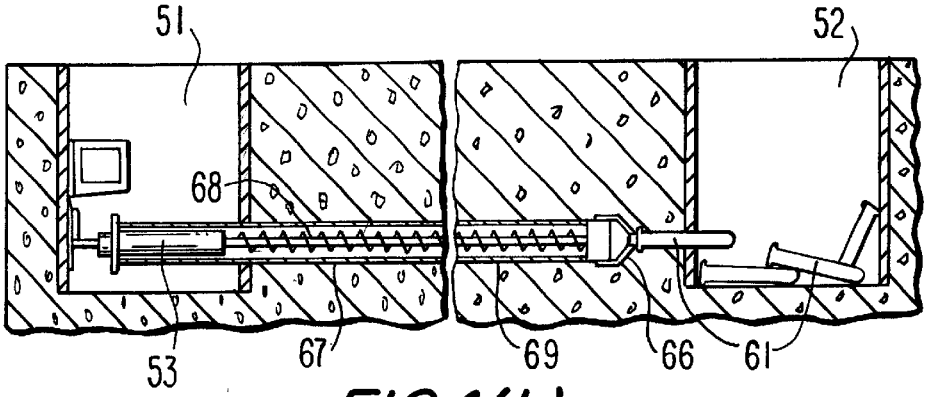
Figure 4C:
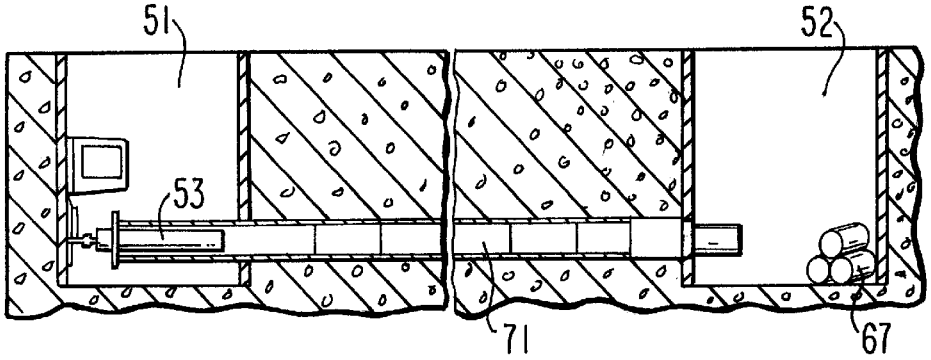

Referring now to FIGS. 4(*a*), 4(*b*) and 4(*c*), a typical three-phase microtunneling installation is illustrated. Preparatory work includes digging a jacking or displacement shaft 51 and a target shaft 52. A displacement machine 53 will be installed in jacking shaft 51.

Figure 5:
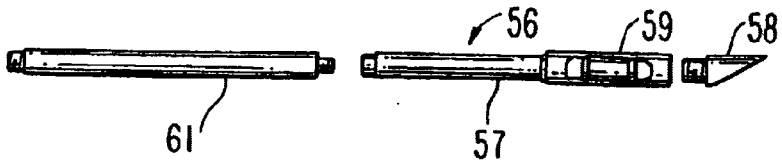
FIG. 5 is an elevational view of the pilot pipe tip assembly used in the first phase of the microtunneling process of FIG. 4(*a*)
Figure 6:
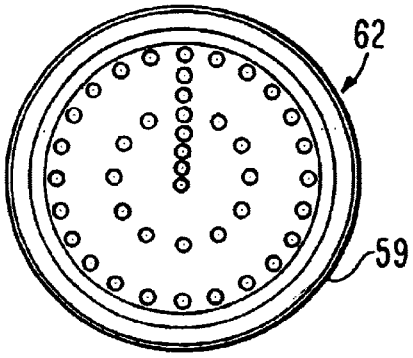
FIG. 6 is an end view of the LED end of the target in FIG. 5.
Figure 7:
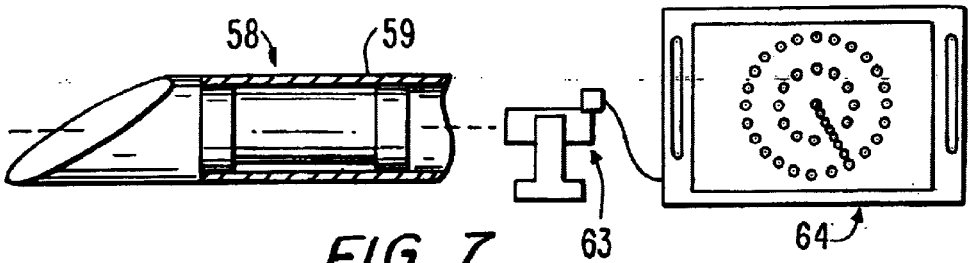
FIG. 7 is a schematic installation of the steering tip of the pilot pipe tip with target in place, theodolite and monitor image of the target of FIG. 6.

At the commencement of the installation, a pilot pipe tip assembly 56 illustrated in FIG. 5 is inserted into displacement machine 53. As shown in FIG. 5, pilot pipe tip assembly 56 includes a leading hollow pilot tube section 57 with a steering tip 58. A target 59 having an LED pattern 62 is inserted at the distal end of pilot pipe tip assembly 56 prior to coupling steering tip 58 to pilot tube 57 that makes up the length of pilot pipe.

The pilot tube tip 58 and additional segments of pilot tubes 61 to a form pilot pipe 54 are all hollow. An LED pattern 62 can be viewed during the entire displacement step and steering tip 58 precisely aligned utilizing a theodolite 63 positioned at the rear operating end of displacement machine 33. The image recorded by theodolite 63 is projected on a monitor 64 so that an operator can make appropriate adjustments in direction of steering tip 58 as it is being displaced.

Referring now to FIG. 4(*b*), as additional segment of pilot tubes 61 are jacked into place so that pilot pipe tip assembly 56 enters target shaft 52, the second phase of the installation begins. Here a reamer 66 is coupled to the last segment of pilot tube 61 with a temporary steel casing 67 attached to the back and an auger 68 is positioned within casing 67. Auger 68 removes soil from an enlarged bore 69 formed by reamer 66. As sections of steel casing 67 are jacked into bore 69 auger 68 causes soil to be displaced into jacking shaft 51 where it is removed above ground. Once all sections of pilot tube 61 are removed through target shaft 52, a product pipe 71 is pushed into place by displacement machine 53 as shown in FIG. 4(*c*). Product pipe 71 displaces steel casings 67 and augers 68 into target shaft 52 where they are removed.

Microtunneling operation can also be performed in two phase process. In this case temporary steel casings 67 and augers 68 are positioned within product pipes 71 coupled to the back end of reamer 66. All three elements are displaced towards target shaft 52 with soil removed in jacking shaft 51 in the same manner as in the three-phase operation. Once segments of product pipe 71 are in place, temporary steel casing 67 and auger 68 are removed through jacking shaft 51.

The speed at which a product pipe can be installed utilizing microtunneling is considerably slower than by horizontal directional drilling. This is due in part to the need to establish and prepare two shafts and a displacement machine must be accurately and securely positioned within the jacking shaft prior to displacement of any pipe. The casings and pipe sections are shorter than a drill pipe section used in directional drilling. Thus, the overall operation is considerably slower. When installing product pipes between 15 to 24 inches, microtunneling generally permits installation of about 200 feet in 5 days.

Figure 8:
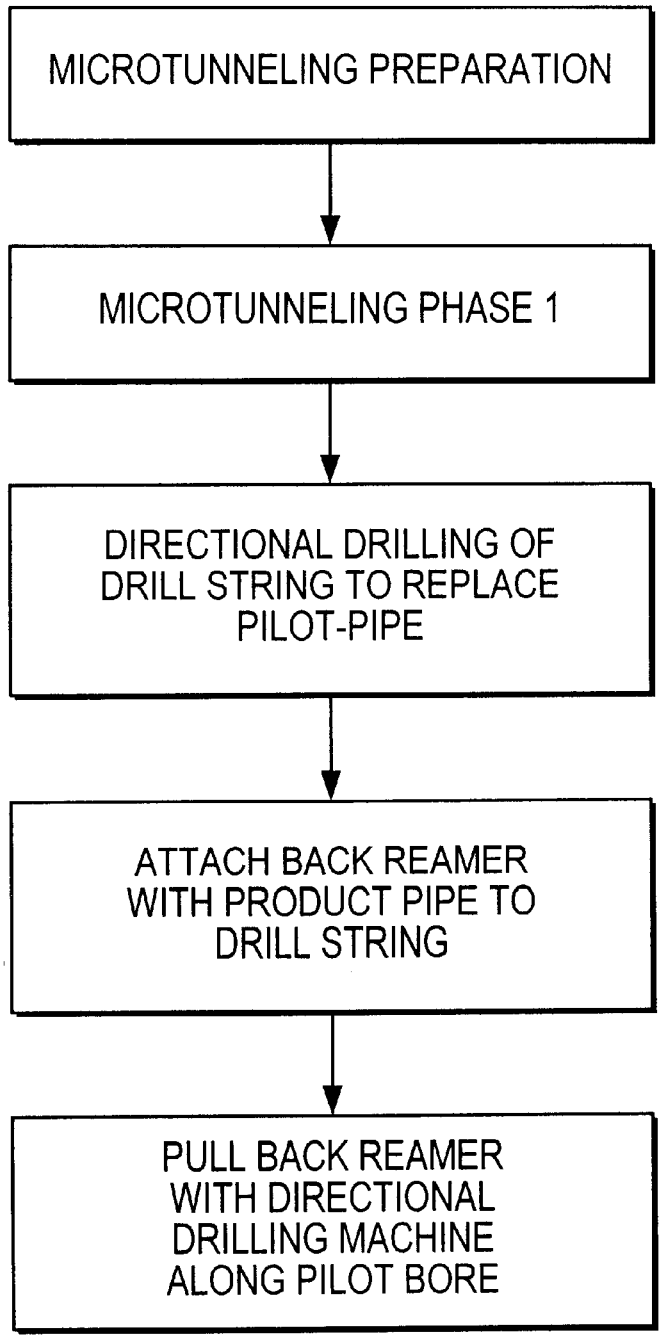
FIG. 8 is a flowchart of the steps if the installation process in accordance with the invention.
Figure 9A:
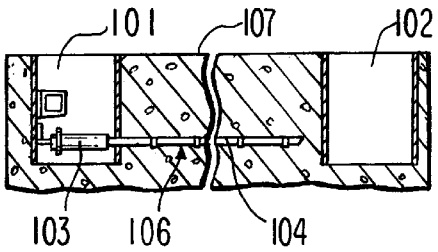
FIGS. 9(*a*) through 9(*e*) are schematic illustrations of the installation steps of the process of trenchless installation of underground pipe in accordance with one embodiment of the invention.
Figure 9B:
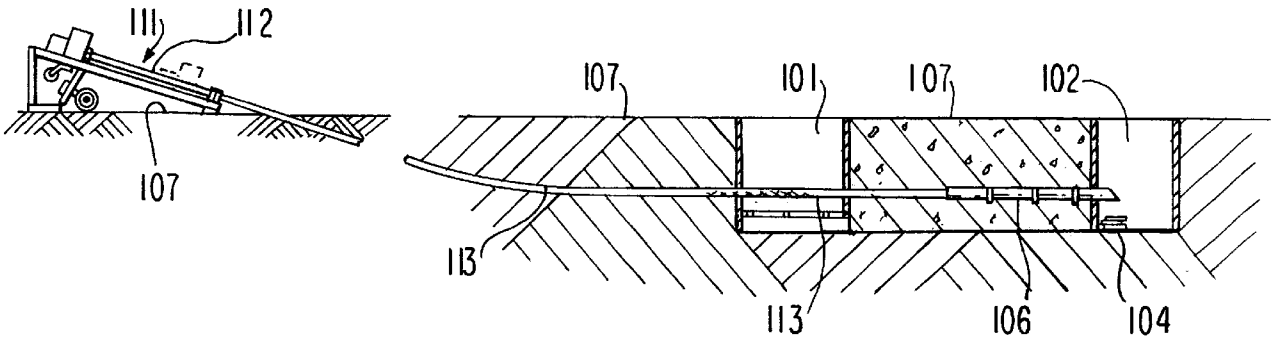
Figure 9C:
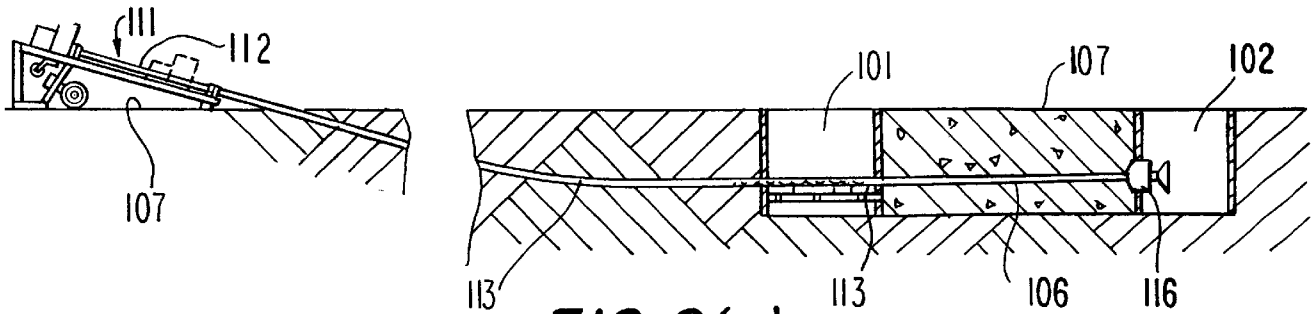
Figure 9D:
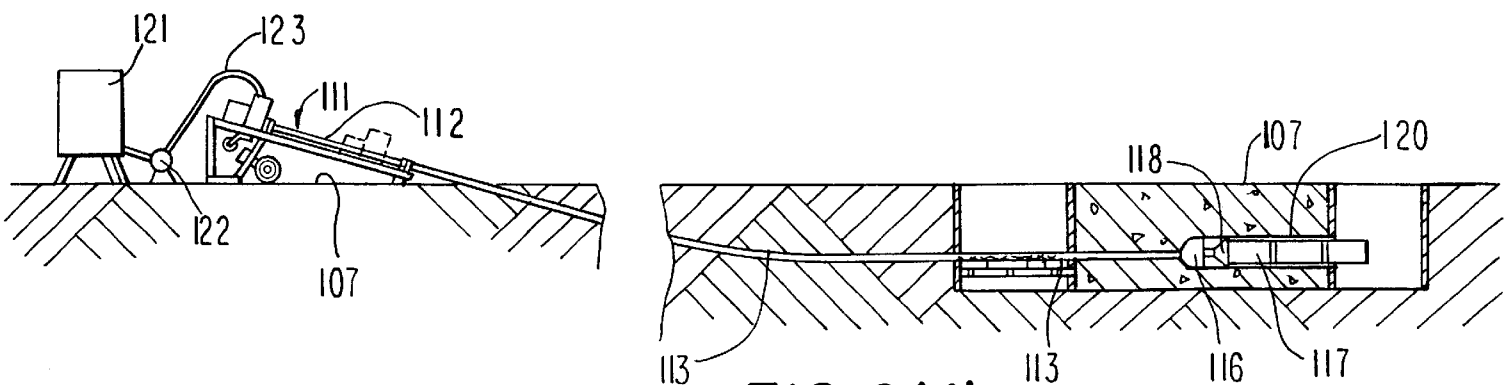
Figure 9E:
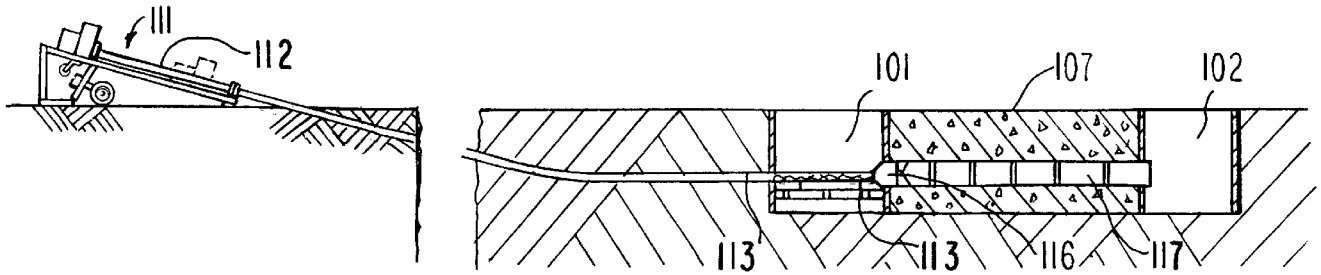

Referring now to FIG. 8, a flow chart showing the steps of the trenchless method in accordance with the invention is shown. Initially, preparatory steps of digging and lining a jacking shaft and a target shaft are performed. Then phase one of a standard microtunneling installation of a pilot pipe is performed from jacking shaft 51 as illustrated in FIG. 4(*a*). This allows for precise on-line and on-grade installation of pilot pipe 62. Once pilot pipe 62 is in place, a directional drilling machine is utilized to displace pilot tubes 61 by a drill string. As in the case of horizontal directional drilling shown in FIG. 1, drill string segments are approximately 15 feet in length and installed from the surface. Generally, a directional drilling machine is positioned about five feet from the grade of the pilot pipe for each one foot in depth, and at least a minimum of 15 feet from that point. In this example, for a pipe installed 20 feet below the surface, the directional drilling machine entry point would be at least 100 feet back.

Once the pilot pipe is replaced with the drill string, a back reamer is coupled to the distal end of the drill string with a product pipe connected to the back end of the back reamer. The back reamer with product pipe attached is then rotated by drill string to cause enlargement of the bore formed by phase 1 of the microtunneling operation.

The back reamer is selected to be somewhat larger than the diameter of the product pipe to form an annulus between outer wall of the product pipe and the bore. This permits introduction of water or drilling fluid to the face of the back reamer through the drill string to facilitate enlargement of the bore of the pilot tube. The slurry formed by the water or drilling fluid is forced back along the annulus to the target shaft where it is removed to ground level. Back reamer may continue until the back reamer enters the jacking shaft whereupon the installation of the product pipe is complete. By performing the installation in this manner utilizing various processing aspects of microtunneling and directional drilling, increase speed in attained while maintaining the precise accuracy obtained in microtunneling.

Referring now to FIGS. 9(*a*) through 9(*e*), the processing steps of the trenchless installation of underground pipe in accordance with the invention is shown. IN an exemplary process, the installation is commenced in a jacking shaft 101 to a target shaft 102 to form a pilot bore 106 about 20 feet below a surface 107. A displacement machine 103 is positioned in jacking shaft 101. A 4 inch diameter steerable pilot tube 104 is displaced underground toward target shaft 102 by utilizing the accurate placement principles discussed with respect to microtunneling phase 1 and illustrated in connection with FIG. 4(*a*). These dimensions are set forth for purposes of illustration only and not in a limiting sense.

Once pilot pipe 104 is in place, a horizontal directional drilling machine 111 similar to that described in connection with FIG. 2 is positioned in an appropriate distance from jacking shaft 101. Since pilot pipe 104 is about 20 feet below surface 107 at jacking shaft 101 drilling machine 111 is positioned approximately 100 to 125 feet from shaft 101. A plurality of sections of a drill pipes 112 for forming a drill string 113 with a hollow core 114 are fed into bore 106 formed by pilot tube 104 from above surface 107 at entry point 108. A plurality of opening 115 in drill string 113 permit wetting the soil at the cutting face of reamer 116. As noted, drilling machine 111 is positioned at least 100 feet from shaft 101 to allow for drill string 113 to be on line when it reaches pilot bore 106. At this time, drilling continues and pilot tube sections 104 are displaced into target shaft 102 as shown in FIG. 9(*b*). Drill string is about 3.5 inches in diameter and 4 inches at section couplings.

Turning now to FIG. 9(*c*), a back reamer 116 is secured to drill string 113 in target shaft 102. A product pipe 117 coupled to a swivel connector 118 attached to the back of reamer 116. Drilling machine 111 is then operated in a reversed direction to displace back reamer 116 from target shaft 102 towards jacking shaft 101 after while removing drill pipe sections 112 above surface 108. As back reamer 116 begins to be displaced along pilot bore 106, a first section of product pipe 117 is coupled to the rear surface of back reamer 121 and pulled into an enlarged bore 118 formed by back reamer 112. Water or a drilling fluid is fed from a reservoir 121 by a pump 122 to a hose 123 to wet soil about back reamer 116 through the hollow core of drill string 113 to openings 115.

Figure 10:
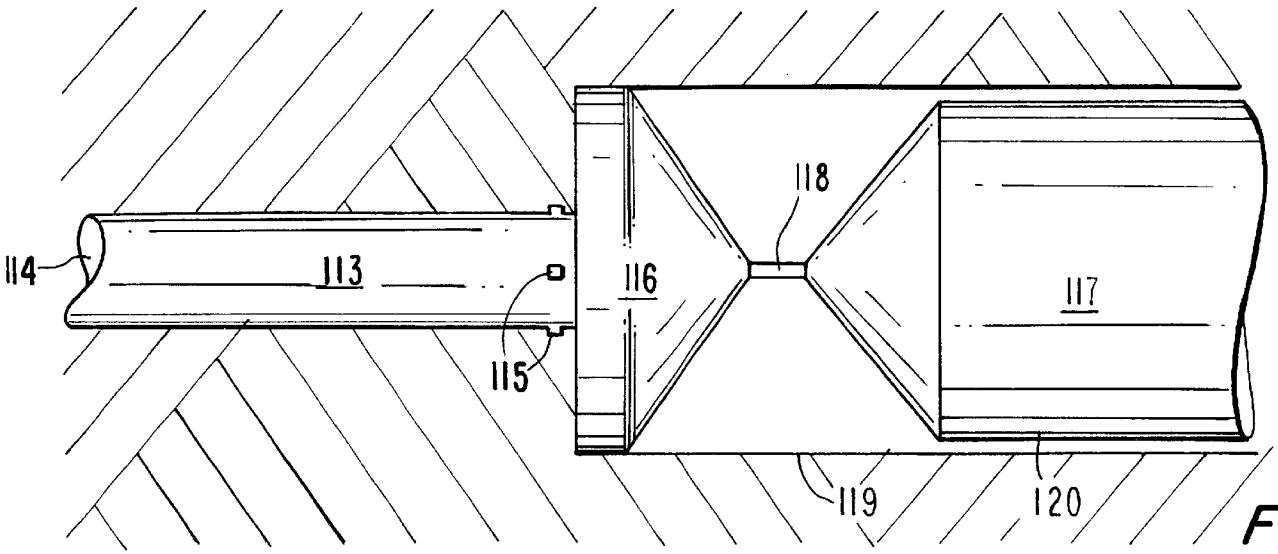
FIG. 10 is an enlarged schematic view showing the pull back of the drill string and pull in of the reamer with product pipe in accordance with the invention.
Figure 11A:
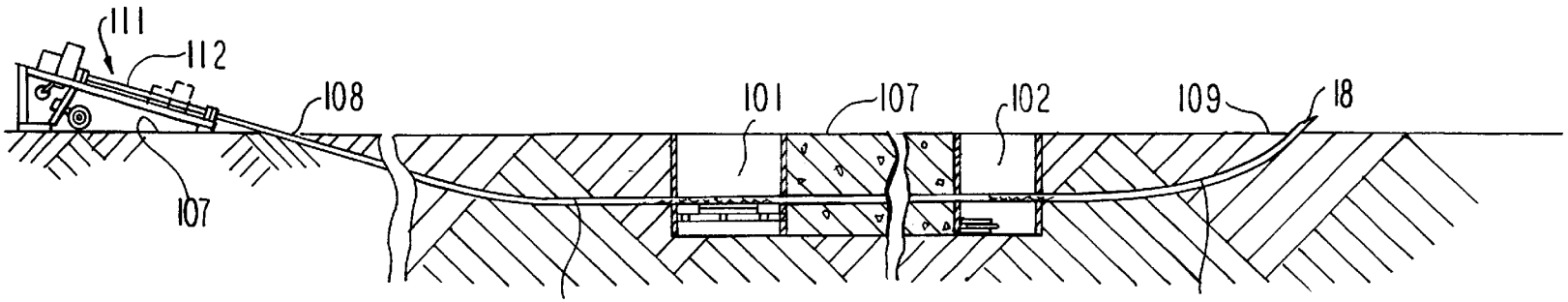
FIGS. 11(*a*) through 11(*d*) are schematic illustrations of the installation steps of the process in accordance with another embodiment of the invention.
Figure 11B:
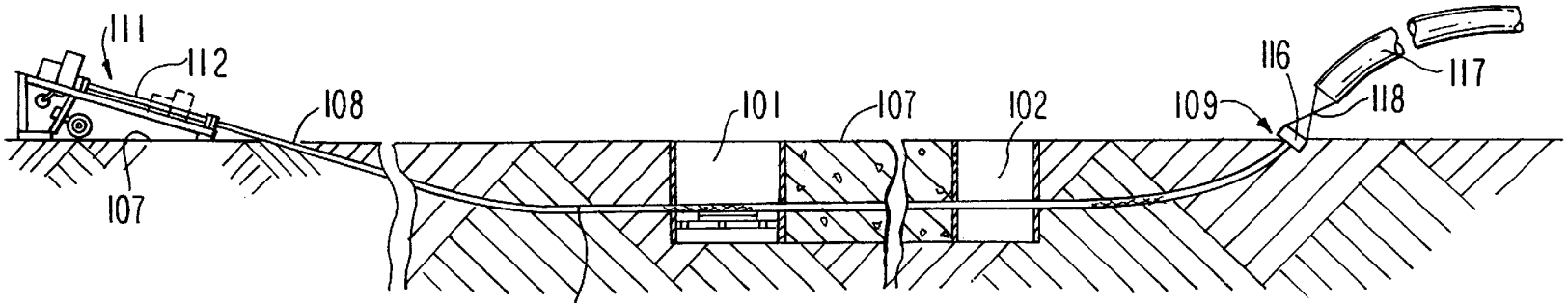
Figure 11C:
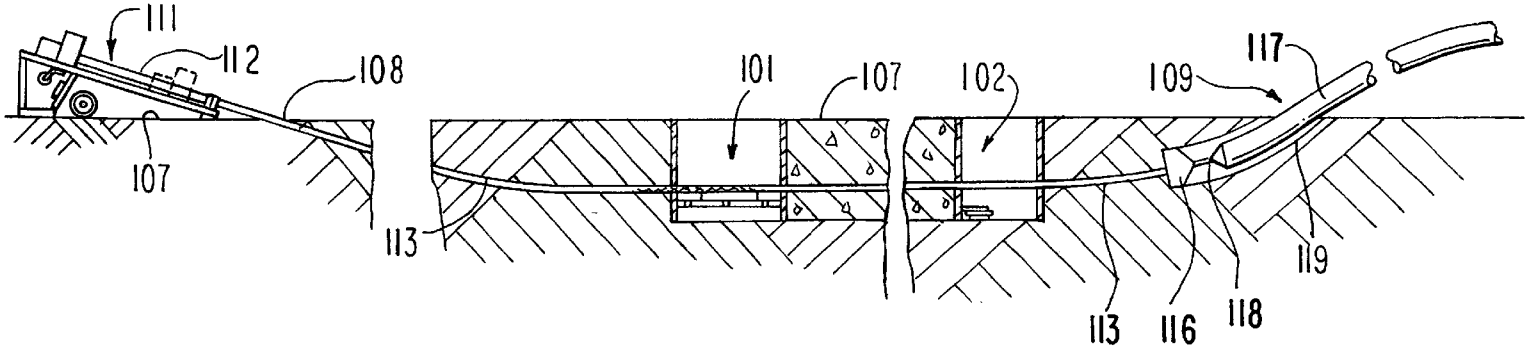
Figure 11D:
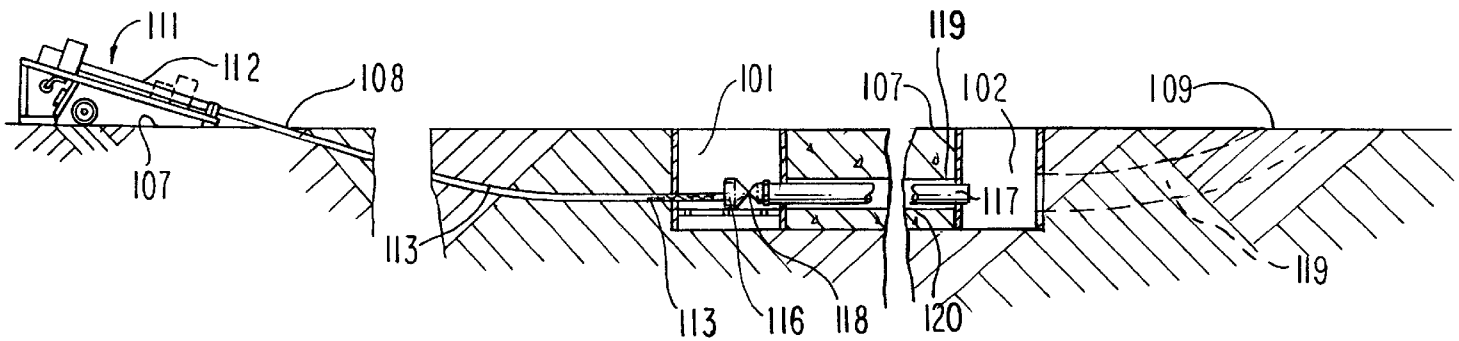

The diameter of back reamer 116 is larger than the outside diameter of product pipe 117. In the case where product pipe 117 has an 18 inch outer diameter, back reamer 116 has a diameter of approximately 20 inches. In this case, a 1-inch annulus 120 is formed about product pipe 117. A larger or smaller annulus may be used. This permits wetted soil to be forced back to target shaft 102 for subsequent removal to surface 107. FIG. 10 shows this in an enlarged view.

Turning now to FIG. 9(*e*), back reamer 116 is shown having traversed the full length of pilot hole 107 to jacking shaft 101. Additional sections of product pipe 117 have been pulled in and now accurately fill the distance between jacking shaft 101 and target shaft 102 along pilot bore 106. Back reamer 116 can now be removed through jacking shaft 101 and the trenchless installation of product pipe 117 is complete. After this, the upper portions of shaft lining 101 and 102 are removed and the lower portions of the shaft can be refitted as manholes in the sewer system.

Referring now to FIGS. 11(*a*) through 11(*d*), the process of accurate installation in accordance with another embodiment of the invention is illustrated. In FIG. 11(*a*) a drill string 113 and a drilling bit 18 exit surface 107 at an exit opening 109. At this point, back reamer 116 is coupled to drill string 113 above surface 107 as shown in FIG. 11(*b*). Swivel connection 118 and product pipe 117 are then attached to the back end of back reamer 116.

In the case that product pipe 118 is a length of HDPE length of up to 1,000 feet can be installed. It is to be understood that while the embodiments are described with respect to a single jacking shaft and target shaft, a length of product pipe can be pulled in behind back reamer 116 through a succession of shafts by boring machine 111.

As back reamer 116 enters the soil an enlarged bore 119 somewhat larger than the diameter of product pipe 117 is formed. The back reaming process continues product pipe 117 has been positioned between the terminal shaft positions in the underground system. Enlarged bore 119 remaining from target shaft 102 to exit opening 109 is then refilled to complete the installation. Back reamer 116 and swivel coupling 118 are readily removed from jacking shaft 101.

In the installation described in connection with the embodiments of FIGS. 9(*a*) to 9(*e*) and FIGS. 11(*a*) to 11(*e*), pilot pipe has a diameter of approximately 4 inches and drill pipes are about 3.5 inches in diameter with coupling to 4 inches. Back reamer 116 has a diameter of about 20 inches and product pipe 117 is about 18 inches in diameter. In an installation of these dimensions, it has been found that the process can install from about 500 to 1000 feet in 4 days. This includes 3 days of shaft preparation and pilot pipe installation and 1 day to do the directional drilling and pull back of the back reamer and product pipe. In contrast when installation is done utilizing the two step microtunneling process of FIGS. 4(*a*) to 4(*c*) about 200 feet can be installed in approximately five days. This include 1½ days of shaft preparation and to install the pilot pipe, 3 days to install product pipe with a temporary casing and auger and 0.5 days to remove equipment.

The process in accordance with the invention requires construction of the jacking and target shafts to allow for the precise alignment in installation of the pilot tube. However, the directional drilling-type machine may be used to install the drill string to replace the pilot pipe at a faster rate than possible with a displacement machine and similarly perform the back reaming operation while pulling in the product pipe from the target shaft. Thus, new underground pipe can be installed utilizing the accuracy available only with microtunneling, yet increase the speed by combining it with various steps of directional drilling.

It will thus be seen that the objects set forth above, among those made apparent from the preceding description are efficiently attained and, since changes may be made in carrying out the above method without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall there between.

What is claimed is:

1. A process for the trenchless installation of an underground product pipe from a first location to a second location at a predetermined depth, comprising:

digging a first access shaft at the first location and a target access shaft at the second location to the predetermined depth;

installing a pipe displacement machine in the first access shaft;

jacking a steerable pilot tube and additional pilot tube sections below grade at the predetermined depth into the ground from the first access shaft to the target shaft displacing the soil to form a pilot pipe from the first access shaft to the target shaft;

installing a drill string from above ground to replace the pilot pipe;

attaching a back reamer of a first diameter to the drill string at the target shaft;

pulling the back reamer from the target shaft to the first access shaft.

2. The process of claim 1, wherein the drill string is installed utilizing a horizontal directional drilling machine.

3. The process of claim 2, wherein the horizontal directional drilling machine is positioned from the first access shaft a distance of at least about 15 feet with at least 5 feet of distance for each foot that the pilot pipe is below the surface.

4. The process of claim 1, wherein the back reamer is pulled through the bore formed by the drill string by reverse pulling of the horizontal directional drilling machine.

5. The process of claim 1, including coupling a product pipe to the back reamer and pulling the product pipe into the line of the pilot pipe as the back reamer is pulled to the first access shaft.

6. A process for the installation of a trenchless underground product pipe from a first location to a second location at a predetermined depth, comprising:

digging a first access shaft at the first location and a target access shaft at the second location to the determined depths;

installing a pipe displacement machine in the first access shaft;

jacking a steerable pilot tube and additional pilot tube sections below grade at the predetermined depth into the ground from the first access shaft to the target shaft displacing the soil about the pilot tubes to form pilot pipe from the first access shaft to the target shaft;

installing a drill string from above ground at a distance from the first access shaft to replace the pilot pipe;

continuing the installation of the drill string through the target shaft to exit the ground at an exit opening a distance from the target shaft;

attaching a back reamer of a first diameter to the drill string on the surface a distance from the target shaft;

pulling the back reamer from the exit opening to the target shaft and to the first access shaft; and filling in the bore formed between the target shaft and the surface exit opening.

7. The process of claim 6, wherein the drill string is installed utilizing a horizontal directional drilling machine.

8. The process of claim 7, wherein the horizontal directional drilling machine is positioned from the first access shaft a distance of at least about 15 feet with at least 5 feet of distance for each foot that the pilot pipe is below the surface.

9. The process of claim 7, wherein the back reamer is pulled through the bore formed by the drill string by reverse pulling of the horizontal directional drilling machine.

10. The process of claim 6, wherein the product pipe is a continuous length of pipe.

11. A process for the trenchless installation of an underground product pipe from a first location to a second location at a predetermined depth, comprising:

digging a first access shaft at the first location and a target access shaft at the second location to the predetermined depth;

installing a pipe displacement machine in the first access shaft;

jacking a steerable pilot tube and additional pilot tube sections into below ground at the predetermined depth the ground from the first access shaft to the target shaft displacing the soil to form a pilot pipe from the first access shaft to the target shaft;

installing a drill string from above ground to replace the pilot pipe;

positioning a horizontal drilling machine a distance of about 15 feet from the first access opening for each 5 feet for each foot the pilot pipe is below the surface.

attaching a back reamer of a first diameter to the drill string at the target shaft;

pulling the back reamer from the target shaft to the first access shaft;

attaching a product pipe coupled to the back side of the back reamer; and pulling the back reamer and product pipe from the target shaft to the first access shaft.

12. A process for the trenchless underground product pipe from a first location to a second location at a predetermined depth, comprising:

digging a first access shaft at the first location and a target access shaft at the second location to the determined depths;

installing a pipe displacement machine in the first access shaft;

jacking a steerable pilot tube and additional pilot tube sections below ground at the predetermined depth into the ground from the first access shaft to the target shaft displacing the soil about the pilot tubes to form pilot pipe from the first access shaft to the target shaft;

installing a drill string from above ground at a distance from the first access shaft to replace the pilot pipe;

continuing the installation of the drill string through the target shaft to exit the ground at an exit opening a distance from the target shaft;

positioning a horizontal direction drilling machine a distance of about 15 feet from the first access shaft for each 5 feet for each foot that the pilot pipe is below the surface;

attaching a back reamer of a first diameter to the drill string at the surface a distance from the target shaft;

pulling the back reamer from the exit opening to the target shaft and to the first access shaft;

attaching a product pipe to the back side of a back reamer;

pulling the back reamer and product pipe from the target shaft to the first access shaft; and filling in the bore formed between the target shaft and the surface exit opening.

* * * * *